US006409168B1

(12) United States Patent
Leu

(10) Patent No.: US 6,409,168 B1
(45) Date of Patent: Jun. 25, 2002

(54) DEVICE FOR TRANSFORMING AN OVERLAPPING STACK OF OBJECTS INTO AN OVERLAPPING ARRANGEMENT

(75) Inventor: Willy Leu, Pfäffikon (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/582,124

(22) PCT Filed: Dec. 29, 1998

(86) PCT No.: PCT/CH98/00557

§ 371 (c)(1),
(2), (4) Date: Jun. 22, 2000

(87) PCT Pub. No.: WO99/35071

PCT Pub. Date: Jul. 15, 1999

(30) Foreign Application Priority Data

Dec. 30, 1997 (CH) ..... 2982/97

(51) Int. Cl.[7] ..... B65H 5/34

(52) U.S. Cl. ..... 271/270; 271/84; 271/271; 271/202

(58) Field of Search ..... 271/128, 42, 140, 271/143, 271, 149, 84, 270, 202; 198/216, 459.8, 736, 728

(56) References Cited

U.S. PATENT DOCUMENTS 4,072,228 A * 2/1978 Honegger et al. ..... 271/202
4,667,950 A 5/1987 Linder et al.
4,688,781 A * 8/1987 Blessing ..... 271/128
4,746,004 A * 5/1988 Hess et al. ..... 271/202
4,905,981 A 3/1990 Reist
5,158,277 A 10/1992 Reist
6,016,747 A * 5/2000 Beduhm et al. ..... 271/270

FOREIGN PATENT DOCUMENTS

CH 631 410 A5 8/1982
EP 0 254 851 A1 2/1988

* cited by examiner

*Primary Examiner*—H. Grant Skaggs
(74) *Attorney, Agent, or Firm*—Alston & Bird LLP

(57) ABSTRACT

An apparatus for transforming an overlapping stack of flexible flat objects, such as printed products, arriving on a first conveyor into an overlapping formation on a second conveyor which is positioned downstream of the first conveyor. A displacement element is guided to reciprocate on a guide rail and has a hook which acts to engage and displace each of the objects from the first conveyor into an active region of the second conveyor. The second conveyor is driven at a conveying speed which is greater than that of the first conveyor. Also, the speed of the displacement element in the direction of conveyance is greater than the conveying speed of the first conveyor, and thus the objects are fed to the second conveyor separately and at an increased spacing.

15 Claims, 3 Drawing Sheets

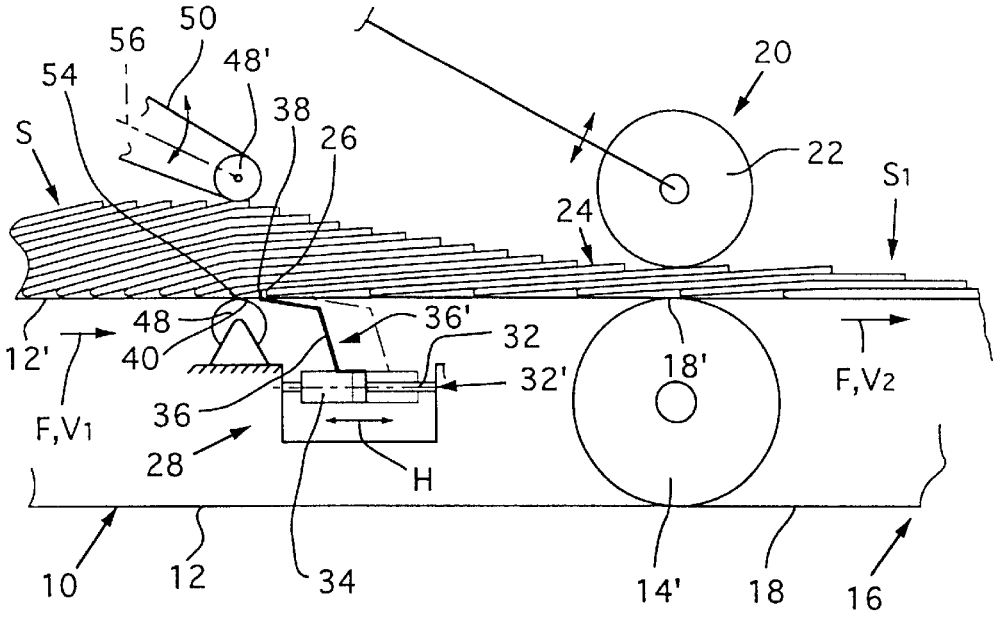
Fig.3
Fig.2
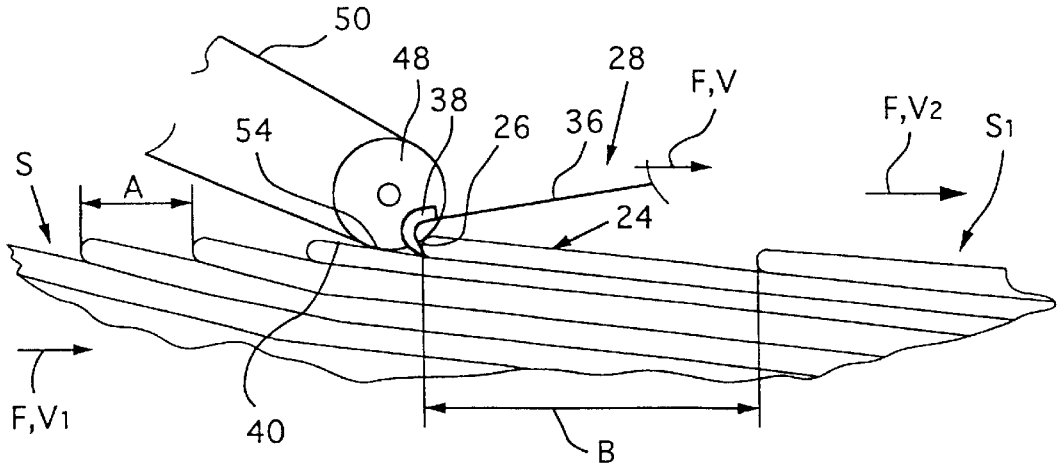

DEVICE FOR TRANSFORMING AN OVERLAPPING STACK OF OBJECTS INTO AN OVERLAPPING ARRANGEMENT

BACKGROUND OF THE INVENTION

The present invention relates to an apparatus for transforming an overlapping stack formed of flat objects, in particular printed products, arriving on a first conveyor into an overlapping formation.

It is often the case that flexible flat objects, in particular printed products, for the purpose of further processing are unwound from a storage coil, in which they are arranged in a closely overlapping formation, or they are deposited on a belt conveyor, arranged in a horizontal stack, a so-called bar and are tilted. The corresponding edges of adjacent object have a relatively small spacing. This spacing is subject to considerable scatter. For the further processing of these objects arranged in a stack it is then often necessary to increase the spacing between the mutually corresponding edges of the objects. This is where the present invention intervenes.

It is an object of the present invention to provide an apparatus for transforming an overlapping stack formed of flat objects arriving on a first conveyor into an overlapping formation, said apparatus ensuring the reliable formation of the overlapping formation with a simple construction.

SUMMARY OF THE INVENTION

The above and other objects and advantages of the present invention are achieved by the provision of an apparatus of the described type which comprises a displacement device which includes a guide means which guides a displacement member in an operating region and at least approximately in the conveying direction of the first conveyor. The displacement member is moved cyclically in the conveying direction through the operating region at a speed that is higher than the conveying speed of the first conveyor. Thus the objects are each displaced by the displacement member into an active region of a second conveyor which is driven at a conveying speed which is higher than that of the first conveyor.

In order to form the overlapping formation, each object is displaced individually, being carried along positively, as far as the downstream end of the operating region.

The number of operating strokes per unit time of the displacement member which is intended to act on the rear edge of the arriving objects is greater than the possible number of objects arriving per unit time. At a given conveying speed of the overlapping stack, this is given in the case of objects whose rear edges have a permissible minimum distance. Since the displacement members themselves execute more than one operating stroke, as referred to a single object, it is ensured that each of the objects is displaced individually and fed to the second conveyor, which is driven at a higher conveying speed.

BRIEF DESCRIPTION OF THE DRAWINGS

The present invention will be explained in more detail using exemplary embodiments which are illustrated in the drawing, in which, in purely schematic form:

FIG. 2 shows, likewise in side view and enlarged with respect to FIG. 1, part of the apparatus shown there;

FIG. 3 shows a side view of part of an apparatus for enlarging the distance between the rear edges of successive articles which arrive in a compacted overlapping formation, in which each object rests on the preceding one;

DESCRIPTION OF THE PREFERRED EMBODIMENTS

Figure 1:
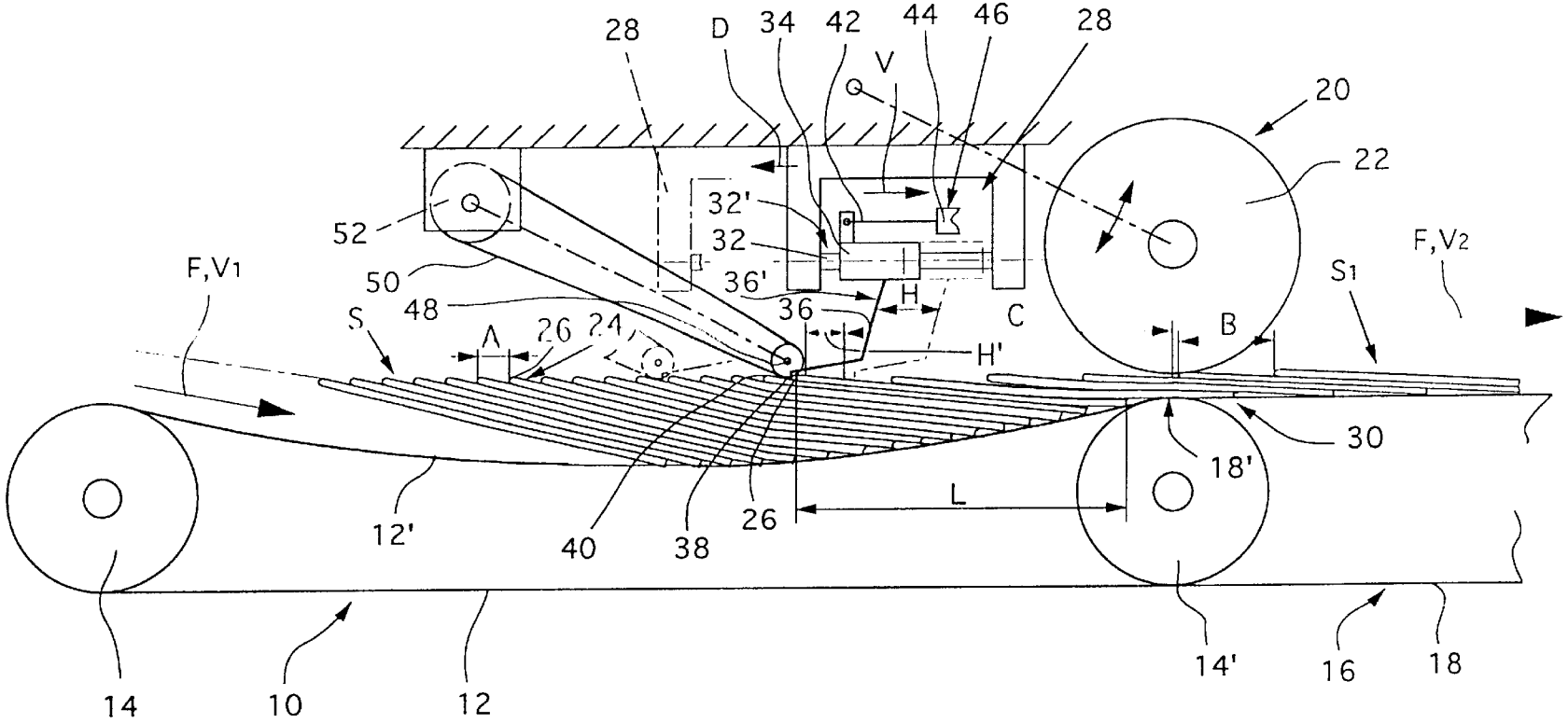
FIG. 1 shows a side view of a first embodiment of the apparatus for enlarging the distance between the rear edges of successive objects which arrive in a compacted overlapping formation, in which each object rests on the following one.

The apparatus shown in FIGS. 1 and 2 has a first conveyor 10 constructed as a belt conveyor, which is driven in the conveying direction F at a first conveying speed $v_1$. At its upstream and its downstream end, the conveyor belt 12, which is formed from a number of endless tapes made of resilient material arranged beside one another, is led around turn rollers 14 and 14'. Connected immediately downstream of the first conveyor 10 is a second conveyor 16, which is likewise constructed as a belt conveyor and whose conveyor tapes 18, arranged beside one another, are guided at the upstream start around turn wheels, which are arranged between the downstream turn rollers 14' of the first conveyor 10 and are mounted coaxially with the latter. The second conveyor 16 is driven in the conveying direction F at a second conveying speed $V_2$, which is higher than the first conveying speed $v_1$.

Interacting with the second conveyor 16, at its upstream start 18', is a pressing element 20. This has two weighted rollers 22 which are arranged spaced apart in the direction of the axis of the turn rollers 14' and which, together with the corresponding conveyor tapes 18, form a conveying gap at the turn wheels.

The first conveyor 10 is intended to convey flat flexible objects 24, which are arranged in a closely overlapping formation—forming a stack S—and in which each object rests on the following one, covering it virtually completely. In the example shown, the objects 24 are thin printed products, which are arranged in the closely overlapping formation with a minimum distance A between the rear edges 26 of successive objects 24.

Arranged above the first conveyor 10 is a displacement device 28. This is intended to displace the objects 24 conveyed by means of the first conveyor 10 in the closely overlapping stack S one after another individually in the conveying direction F at a speed V that is higher than the first conveying speed $V_1$, and, enlarging the distance from the next object, to feed it to the active region 30 of the second conveyor 16. As a result, an overlapping formation $S_1$ is formed. The active region 30 of the second conveyor 16 begins at its start 18', which is defined by the conveying gap defined by the conveying tapes 18 and the weighted rollers 22. The enlarged distance between the rear edges 26 of successive objects 24 is designated by B in FIG. 1.

The displacement device 28 has a guide means 32' which extends in the conveying direction F and is constructed as a guide rail 32. Freely moveably guided on the guide rail 32 is a slide 34, on which a displacement members 36' is arranged. The latter is constructed as a bow-like displacement element 36 and fastened at one end to the slide 34. At the free end, the displacement element 36, as emerges in particular from FIG. 2, is provided with a hook 38, which is intended to be displaced so as to slide along the upper flat side 40 of the objects 24, because of the spring action of the displacement element 36, and then to come into contact with the rear edge 26 of an object 24 in each case, and to displace this object 24 in the conveying direction F, carrying it along positively.

The slide 34 is connected via a rod 42 to a drive 46 constructed as a piston/cylinder unit 44. The said drive is intended to move the slide 34, together with the displacement element 36, from an upstream starting position, through an operating stroke H in the conveying direction F, into an end position, indicated by dash-dotted lines, and back again cyclically. The piston/cylinder unit 44 is constructed in such a way that it accelerates the displacement element 36 to a constant speed v within a very short section of the stroke H, moves it onward at this speed v and then brakes it to a standstill again likewise within a comparatively very short retardation section. The frequency with which the piston cylinder unit 44 moves the displacement element 36 to and fro in and counter to the conveying direction is selected such that the displacement element in each case executes at least two operating strokes in the conveying direction F within a time period which is determined by the quotient of the permissible minimum distance A between the rear edges 26 of successive objects 24 transported by the first conveyor 10 and the first conveying speed $v_1$. An operating region H' of the displacement element 36, which is given by that section of the stroke H in which the displacement element 36 is moved at a speed v which is higher than the first conveying speed $v_1$, is greater than the permissible minimum distance A. Within this operating region H', the displacement element 36 can catch up with the rear edge 26 of an object 24, come into contact with the rear edge 26 and displace this object 24 in the conveying direction F at the speed v.

A reference roll 48 is freely rotatably mounted so as to be fixed in relation to the guide rail 32; led around said roll is an endless belt 50, which runs around a further roll 52 which, in relation to the reference roll 48, is arranged upstream and at a greater distance than the reference roll 48 from the second conveyor 16. Together with the conveyor belt 12 of the first conveyor 10, the belt 50 forms an inlet for the overlapping formation S and, in that region of the reference roll 48 which faces the conveyor belt 12, forms a reference 54 for the upper edge of the overlapping formation S. As viewed in the conveying direction F, the reference roll 48 is located at least approximately at the upstream start of the stroke H. In addition, the mutual position of the reference roll 48 and the guide rail 32—as viewed perpendicular to the conveying direction F—are coordinated with one another in such a way that the hook 38 of the displacement element 36 rests with prestress on the flat side 40 of the respective object 24 if the overlapping formation S is held in contact with the reference 54 by means of the first conveyor 10. For this purpose, the conveyor belt 10 is of resilient construction in order to form an appropriate sag, and the turn rollers 14, 14' are arranged in relation to the reference roll 48 in such a way that the objects 24 come into contact with the belt 50 in any case. In addition, the reference 54 is arranged in relation to the conveying plane defined by the second conveyor 16 in such a way that it is approximately aligned with a plane which is parallel to the conveying plane and touches the overlapping formation $S_1$ formed from above.

The downstream end of the operating range H' is spaced from the start 18' of the second conveyor 16 by a distance C which is equal to or slightly less than the length L of the objects measured in the conveying direction F when they are acted on by the displacement element 36. As is indicated by the arrow D (FIG. 1) and the position shown with dash-dotted lines of the displacement device 28, the distance C can be adjusted to correspond to the format of the objects 24 to be processed.

In the embodiment shown in FIG. 3, the first conveyor 10, likewise constructed as a belt conveyor, is intended to transport the articles 24 arriving in a closely overlapping stack S, in which each object 24 rests on the preceding one, in the conveying direction F at the first conveying speed $v_1$.

The displacement device 28 is constructed in the same way as the apparatus according to FIG. 1, but arranged in a mirror-image manner. The hook 38, arranged at the free end of the self-sprung displacement element 36, rests with prestress on the flat side 40 of a respective object 24, which is now located at the bottom. It should be mentioned, for completeness, that the conveyor belt 12 is formed by conveying tapes arranged beside one another at intervals, and the displacement element 36 is located between two adjacent conveying tapes. The conveyor tapes, which in this case are not of resilient design, run over a reference roll 48, which is located in the vicinity of the upstream start of the stroke H.

A roll 48' is freely rotatably mounted, opposite the reference roll 48, on a weighted lever 56, which is mounted such it can be pivoted in relation to the conveyor belt 12. Led around this roll 48' and the further roll 52, which is similar to the apparatus according to FIG. 1, is the belt 50, which in turn, together with the conveyor belt 12, forms an inlet for the overlapping formation S and, in the same way as in the embodiment shown further above, prevents the objects 24 being carried along by frictional forces by a preceding object which is moved at a higher speed by means of the displacement element 36.

Figure 4:
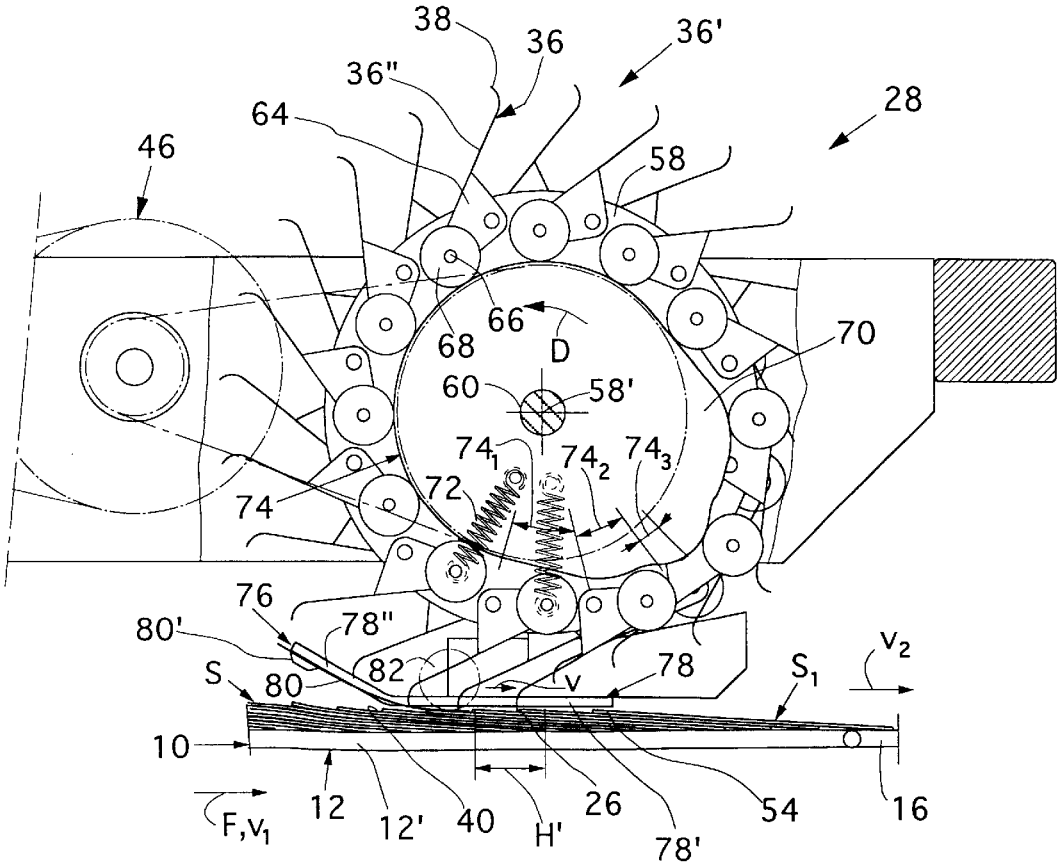
FIG. 4 shows a side view of a further embodiment of the apparatus according to the invention.
Figure 5:
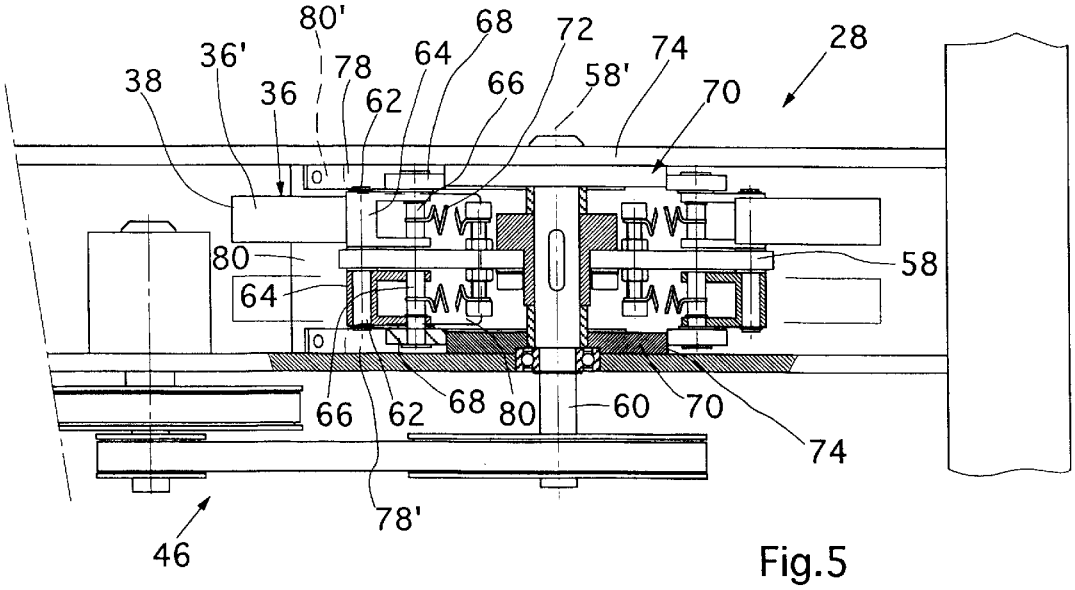
FIG. 5 shows, in plan view and partly sectioned, the embodiment according to FIG. 4.

FIGS. 4 and 5 show an embodiment of the apparatus in which the displacement member 36' has a number of displacement elements 36, twenty-two in the specific case. Said elements are arranged to be distributed uniformly alternately on the two sides of a carrying disk 58, in the circumferential direction along a circle which is concentric with the axis 58' of the carrying disk. The carrying disk 58 is situated on a drive shaft 60 which is concentric with its axis 58' and freely rotatably mounted on the machine frame. Said drive shaft is driven so as to rotate continuously in the direction of rotation D by means of a drive 46.

Each displacement element 36 is constructed in the manner of a two-armed lever and freely pivotably mounted on a bearing shaft 62 which is parallel with the axis 58' and projects from the carrying disk 58. For this purpose, the displacement element 36 has a carrying part 64 of U-shaped cross section, to which the bow 36", which is bent at the free end to form a hook 38 and is made of spring-steel sheet, is fixed. At that end of the carrying part 64 which faces away from the hook 38, a follower roller 68 is freely rotatably mounted on a pin 66 that is parallel to the bearing shaft 62, said roller being intended to interact with the circumferential surface of an associated control disk 70 fixed to the machine frame. In order to keep the follower roller 68 in contact with the control disk 70, one end of a tension spring 70, which runs in the radial direction, is fastened to the pin 66, and its other end is fixed to the carrying disk. The circumferential surface of the control disk 70 thus forms a control cam 74 for controlling the pivoting position of the displacement element 36 on the basis of its rotational position about the axis 58'.

The first conveyor 10, of which the active run 12' of the conveyor belt 12 is shown, runs underneath the displacement device 28. It is driven at the first conveying speed $v_1$ in the conveying direction F, which runs at right angles to the axis 58'. Connected downstream of said first conveyor 10, as in the exemplary embodiments shown further above, is the second conveyor 16, which is driven at a higher conveying speed $v_2$. Here, too, the first conveyor 10 is intended to convey objects 24 arranged in the closely overlapping stack S into the active region of the displacement device 28, which displaces the objects 24 individually one after another in the conveying direction F at a speed v which is higher than the first conveying speed $v_1$ and, whilst enlarging the spacing from the following object 24, feeds them to the active region of the second conveyor 16, by which means an overlapping formation $S_1$ is formed.

Above the first conveyor 10 and below the carrying disk 58, a guide device 76 has two profiled guide elements 78, which are fixed to the machine frame. The guide elements 78 arranged on either side of the movement path of the displacement elements 36 have a rectilinear guide section 78' which runs in the conveying direction F, and an inlet section 78" which is arranged at an oblique angle to said guide section 78' and adjoins it upstream. In the free end region of the inlet section 78", an essentially rectangular spring-steel sheet 80 arranged between the guide elements 78 is fixed to the guide elements 78 at its laterally projecting lugs 80'. It projects in the downwards direction beyond the guide section 78', forming an acute angle with the latter, and ends at the upstream start of the operating region H'. The guide section 78' forms the reference 54 for the rear edges 26 of the objects 24 fed, which, because of the prestress of the first conveyor 10 in the upward direction, are held in contact with the guide section 78'. Together with the first conveyor 10, the inlet section 78" forms a wedge-like tapering inlet to the gap formed by the active run 10' of the conveyor belt 12 and the guide section 78'.

As emerges from FIG. 4, the control cam 74 extends from about 2 o'clock—in the counter-clockwise direction—to about 7 o'clock, concentrically with the axis 58'. In this region, the displacement elements 36 assume an attitude in relation to the circular carrying disk 58 in which the hook 38 trails the follower roller 68 in the direction of rotation D, and the displacement elements 36 approximately forms an angle of 45° with a tangent to the carrying disk 58. As viewed in the direction of rotation D, this region is adjoined tangentially by a rectilinear cam section $74_1$. Since, as viewed in the direction of rotation D, the distance of the cam from the axis 58' increases, in this region the displacement elements 36 are pivoted counter to the direction of rotation D. As they pass through this cam section $74_1$, displacement elements 36 come into contact with the free end of the hook 38 on the upper side of the spring-steel sheet 80, and act on the latter with a force which points in a downward direction.

The cam section $74_1$ is adjoined continuously by a cam section $74_2$, which has the form of an extended S and in which, as viewed in the direction of rotation, the increase in the distance between the control cam 74 and the axis 58' initially decreases and then increases again. While a follower roller 68 is passing through this cam section $74_2$, the relevant displacement element 36 runs off the spring-steel sheet 80, comes into contact with the free end of the hook 38 on the upper flat side 40 of that object 24 on which the spring-steel sheet 80 is resting flat and then, because of the shape of the cam section $74_2$, is pivoted in such a way that the hook 38, in the operating section H', is moved at least approximately along a rectilinear movement path extending in the conveying direction F, the bow 36" being resiliently forced back slightly because of the countering force of the first conveyor 10. As it moves through the operating section H', the hook 38 comes into contact with the rear edge 26 of an object 24 and displaces the latter in the conveying direction F at a speed v which is higher than the speed $v_1$ of the first conveyor, and feeds this object to the second conveyor 16, whilst enlarging the distance to the rear edge of the next object 24. Of course, this is only the case when there is an object in the operating region H'. Otherwise, the relevant hook 38 slides along the flat side 40 of the next object 24, until it is pivoted away by the latter.

The cam section $74_2$ is followed by a cam section $74_3$, in which the distance to the axis 58', as viewed in the direction of rotation D, increases sharply. The start of this cam section $74_3$ coincides, for a displacement element 36, with the end of the operating region H'. This is because, in the cam section $74_3$, the displacement elements 36 are pivoted sharply in the clockwise direction in a very short time, and the relevant hook 38 is lifted out of the movement path of the objects 24.

In the region of the control cam 74 which follows the cam section $74_3$, it is ensured that the displacement elements 36 remain outside the movement path of the objects 24 and are subsequently brought into the pivoted position which they assume in the concentric region of the control cam 74.

In each case, before a hook 38 runs off the spring-steel sheet 80, a next hook 38 has already come into contact with the latter. The force exerted in the downward direction on the spring-steel sheet 80 by the displacement elements 36 reinforces the retaining action of the spring-steel sheet 80 on the object 24, on which it rests flat, and prevents the latter being carried along as a result of friction while the preceding object 24 is being accelerated.

In this embodiment, the same conditions apply to speeds, distances and frequency as in the embodiments shown further above. In this case, the frequency is to be understood as the number of displacement elements 36 which are moved into the operating region H' per unit time.

In addition, it should be mentioned that the guide sections 78' of the guide elements 78 prevent the objects 24 being able to be bent up under the action of the hook 38. In addition, lateral hold-down rollers 82 prevent the objects 24 being able to lift up in their lateral edge regions.

By means of the embodiments shown of the apparatus, the closely overlapping stack S is "pulled apart" to form an overlapping formation $S_1$. The movement of the displacement element need not be coordinated with a system cycle rate, neither in relation to phase angle nor in relation to frequency. However, a condition is that the frequency of the movement of the displacement element is higher than the highest possible frequency at which the objects can arrive.

It is also conceivable for the displacement member 36' of the embodiments shown in FIGS. 1 to 3 to have two displacement elements 36, which are driven in antiphase at half the frequency, but at a higher speed v in the conveying direction F than the first conveying speed $v_1$. It is also conceivable to provide more than two displacement elements.

The apparatus is particularly suitable to enlarge the distance between objects occurring in an irregular, closely overlapping formation. Since neither synchronization with a system cycle rate, nor phase adaptation is necessary, the construction and the drive can be constructed extremely simply.

In a preferred way, the second conveying speed $v_2$ is approximately 3 to 4 times as high as the first conveying speed $v_1$. In addition, it is advantageous for the number of operating strokes of the displacement member 36' per time interval, defined by the quotient of the minimum distance A and the first conveying speed $v_1$, to be about 3 to 4. In addition, it has been shown that the operating region H' is preferably 1.5 times, advantageously about 2 to 3 times, as large as the minimum distance A.

As a rule, the second conveying speed $v_2$ is predefined. The first conveying speed $v_1$ is then adjusted in such a way that the displacement member 36' with certainty never catch and displace two objects with each other.

What is claimed is:

1. Apparatus for converting the formation of sheet-like articles which are fed on a first conveyor driven at a first conveying speed and, by a displacement arrangement are transferred individually from a first formation into an imbricated formation and into an active region of a second conveyor, driven at a second conveying speed, which is greater than the first conveying speed, wherein the displacement arrangement has a displacement member which is provided with a hook and, by means of a drive and a guide means can be displaced cyclically in an operating region, at least more or less in the conveying direction of the first conveyor, at a speed which is greater than the first conveying speed, such that the sheet-like articles in the first formation, which forms an imbricated stack, can be gripped individually by the hook and transferred to the second conveyor, and into the imbricated formation.

2. Apparatus according to claim 1, wherein the drive moves the displacement member through the operating region at least approximately twice in the conveying direction in a time period which is determined by the quotient of a permissible minimum distance between the rear edges of successive objects in the arriving stack and the first conveying speed.

3. Apparatus according to claim 1, wherein the first conveyor comprises a belt conveyor whose conveying run, in the presence of a stack, can form a sag such that the object respectively to be caught by the displacement member is located at least approximately in an attitude parallel to the movement path of the displacement member in the operating region.

4. Apparatus according to claim 1, wherein the operating region of the displacement member is arranged at a distance from the active region of the second conveyor which at least approximately corresponds to the length of the objects, measured in the conveying direction.

5. Apparatus according to claim 1, wherein the operating region is greater than the permissible minimum distance between the rear edges of successive objects in the arriving formation.

6. Apparatus according to claim 1, wherein the displacement member is spring biased so as to rest under pre-stress on a flat side of an object which faces it.

7. Apparatus according to claim 1, wherein the displacement member comprises a self-biased, bow-like displacement element which is fixed at one end to a slide guided by the guide means extending at least approximately in the conveying direction, and is provided at the other end with a hook.

8. Apparatus according to claim 1, wherein the displacement member comprises a number of self-biased, bow-like displacement elements which are each provided with a hook, and which are driven so as to circulate along a closed circulation path, and whose position is controlled in such a way that the hooks, as they move through the operating region, are moved at least approximately rectilinearly and in the conveying direction.

9. Apparatus according to claim 1, wherein the second conveyor comprises a belt conveyor and a pressing element which interacts therewith at the start of the active region in order to press each object fed by the displacement member in the direction of the belt conveyor so that such object is carried along positively.

10. Apparatus according to claim 1, further comprising a reference element which is arranged fixed with respect to the guide means and upstream of the operating region and which is intended to rest on the formation on the side facing the guide means.

11. Apparatus according to claim 1, further comprising a pressing means which, with a reference element, forms a gap which can be adapted to the stack, in order to press the objects in the gap onto the first conveyor so that they are carried along positively and thus to prevent their being carried along at higher speed in the conveying direction.

12. Apparatus for transforming an overlapping stack formed of flat objects arriving on a first conveyor into an overlapping formation, and comprising a displacement device which includes a guide means which guides a displacement member in an operating region at least approximately in the conveying direction of the first conveyor, and a drive by means of which the displacement member can be moved cyclically in the conveying direction through the operating region at a speed that is higher than a first conveying speed of the first conveyor, in such a way that the objects arriving are displaced individually by the displacement means into an active region of a second conveyor, which is driven at a second conveying speed which is higher than the first conveying speed, and wherein the first conveyor comprises a belt conveyor whose conveying run, in the presence of a stack, can form a sag such that the object respectively to be caught by the displacement member is located at least approximately in an attitude parallel to the movement path of the displacement member in the operating region.

13. Apparatus for transforming an overlapping stack formed of flat objects arriving on a first conveyor into an overlapping formation, and comprising a displacement device which includes a guide means which guides a displacement member in an operating region at least approximately in the conveying direction of the first conveyor, and a drive by means of which the displacement member can be moved cyclically in the conveying direction through the operating region at a speed that is higher than a first conveying speed of the first conveyor, in such a way that the objects arriving are displaced individually by the displacement means into an active region of a second conveyor, which is driven at a second conveying speed which is higher than the first conveying speed, and wherein the displacement member is spring biased so as to rest under pre-stress on a flat side of an object which faces it.

14. Apparatus for transforming an overlapping stack formed of flat objects arriving on a first conveyor into an overlapping formation, and comprising a displacement device which includes a guide means which guides a displacement member in an operating region at least approximately in the conveying direction of the first conveyor, and a drive by means of which the displacement member can be moved cyclically in the conveying direction through the operating region at a speed that is higher than a first conveying speed of the first conveyor, in such a way that the objects arriving are displaced individually by the displacement means into an active region of a second conveyor, which is driven at a second conveying speed which is higher than the first conveying speed, and wherein the displacement member comprises a self-biased, bow-like displacement element which is fixed at one end to a slide guided by the guide means extending at least approximately in the conveying direction, and is provided at the other end with a hook.

15. Apparatus for transforming an overlapping stack formed of flat objects arriving on a first conveyor into an overlapping formation, and comprising a displacement device which includes a guide means which guides a displacement member in an operating region at least approximately in the conveying direction of the first conveyor, and a drive by means of which the displacement member can be moved cyclically in the conveying direction through the operating region at a speed that is higher than a first conveying speed of the first conveyor, in such a way that the objects arriving are displaced individually by the displacement means into an active region of a second conveyor, which is driven at a second conveying speed which is higher than the first conveying speed, and wherein the displacement member comprises a number of self-biased, bow-like displacement elements which are each provided with a hook, and which are driven so as to circulate along a closed circulation path, and whose position is controlled in such a way that the hooks, as they move through the operating region, are moved at least approximately rectilinearly and in the conveying direction.

* * * * *